US005692416A

United States Patent [19]

Hamblin

[11] Patent Number: 5,692,416

[45] Date of Patent: Dec. 2, 1997

[54] SHOWER HEAD SUPPLY PIPE TOOL

[76] Inventor: Wade C. Hamblin, 6123 S. Van Gogh Cir., Salt Lake City, Utah 84118

[21] Appl. No.: 634,584

[22] Filed: Apr. 18, 1996

[51] Int. Cl.[6] ..... B25B 13/00

[52] U.S. Cl. ..... 81/52; 81/436; 81/120

[58] Field of Search ..... 81/52, 119, 120, 81/176.1, 176.15, 436, 484, 488

[56] References Cited

U.S. PATENT DOCUMENTS 3,314,315 4/1967 Scholl ..... 81/52
4,360,160 11/1982 Jette .
4,503,737 3/1985 Digiovanni .
5,090,276 2/1992 Groskey .
5,172,615 12/1992 Albrecht .

*Primary Examiner*—James G. Smith
*Attorney, Agent, or Firm*—Thorpe, North & Western, LLP

[57] ABSTRACT

A tool is disclosed which is useful to install and remove bent decorative supply pipes such as are exposed between a water service pipe within a wall and a shower dead. The tool has a cylindrical head which is inserted in one end of the supply pipe, a hilt to stop the pipe at a predetermined length of insertion and an elongate handle to rotate the pipe to turn the threads of the supply pipe relative to the threads of the service pipe.

16 Claims, 1 Drawing Sheet

SHOWER HEAD SUPPLY PIPE TOOL

BACKGROUND

1. Field of the Invention

The present invention relates generally to tools for rotational manipulation of shower supply pipes which have a bend in them. More particularly, it concerns a means for manipulation of such a supply pipe to position it in a threaded engagement with a service pipe without marring the decorative surfaces of the supply pipe by effectively extending the radius of rotation of the pipe about the axis of the threads engaging the service pipe.

2. The Background Art and Background of the Invention

It is well known, accepted and desirable that the exposed portion of pipes ultimately supplying shower heads and other exposed plumbing, are decorative in nature. That is, their outside surfaces are finished, polished, and of appealing quality. It is also desirable that such pipes, herein referred to as decorative supply pipes, are bent to bring the water from an unexposed service pipe which is generally parallel to a person within the shower, and which terminates above or near the head, to a position above the person and spraying in a generally downward manner upon exit from the plumbing system. This requires a bend in the supply pipe.

The supply pipe is generally threaded for mating with threads on the service pipe. The proper rotational positioning of the supply pipe determines whether it sprays downward toward the showering person, at a lateral angle, or upward toward the shower ceiling. Thus proper manipulation of the supply pipe is necessary to tightly fitting and mating the threads and achieving the necessary final rotational position. The latter must occur in rotational integers, and the former requires precision. It will be appreciated that these are opposing principles. If it is too tight, it will strip the threads or bend or break the pipe; if it is too loose, the fitting will leak.

The polished finish of most decorative shower supply pipes is easily marred by tools typically used for turning pipes. For example, the teeth of a plumber's wrench readily dig into the outer surface to bite the pipe and impart rotational energy to it. This is not acceptable for decorative supply pipes. Attempts are readily made to soften this approach by installing softer teeth, or imparting a cloth to the surface to try to protect it. This only results in loss of control by such tools.

Another common means of installing such pipes is to turn them in by hand. This results in an insufficient amount of torque on the pipe and consequential leakage of the fitting when it is pressurized. It may also result in injury to the technician. In order to facilitate this type of installation, it is necessary to manufacture pipes of sufficient length to achieve sufficient torque to allow effective rotation at the pressures necessary to properly insert the pipe. This is costly because of the additional raw materials expended and generally increasing every component of the cost of manufacture. It also necessarily results in either a longer service pipe, or a shower head which is too low for effective use by taller users.

Yet another means which is sometimes attempted to accomplish installation, is to insert a tool such as a screw driver, into the opening, thus extending the radius of rotation and the effective torque which can be applied to the Decorative supply pipe. This results in damage to the geometry of the pipe because of intense application of pressure to the interior of the pipe from uncomplimentary mating surfaces and too extensive or incomplete insertion of the tool into the pipe. For example, if the screwdriver is only inserted a short distance into the pipe, it bends the end resulting in elliptical rather than round threads. If it is inserted too far, it exerts pressure on the bend area of the pipe, where even slight disconfigurations are most visible and where the pipe is softest.

All of these solutions suggest means for rotating a decorative supply pipe, but none adequately addresses acceptable means for exertion of additional rotational energy to such a pipe, so as to properly install the same, without marring the outside or otherwise disconfiguring the pipe and/or marring its decorative appearance.

There is thus a need to provide a tool for installing bent decorative supply pipes by exerting non-marring pressure on the pipe to provide the necessary rotational energy to properly install the same.

Those having ordinary skill in the art will appreciate that these and other needs are met by the present invention.

OBJECTS AND SUMMARY OF THE INVENTION

It is therefore an object of the present invention to provide a tool for installing decorative supply pipes which imparts rotational energy to the inside of the pipe.

It is another object of the invention to provide such a tool with a surface which mates with said inside surface without concentrating such energy on a surface which will not mar visible areas or disrupt the mechanical necessaries of the pipe.

It is an additional object of the invention to provide such a tool which provides stopping means such that the tool will be properly positioned in the pipe upon use.

It is also an object of the invention to provide such a tool that is made of a material which is softer than the supply pipe.

The above objects and others not specifically recited are realized in specific illustrative embodiments of a tool for installing decorative shower supply pipes having a cylindrical head for insertion in the pipe, a hilt for precluding movement of the head beyond a predetermined distance within the pipe, and an elongate handle for rotation of the pipe.

In yet another illustrative embodiment of a tool for installing shower head supply pipes, the cylinder has two diameters, one larger and distal to the hilt which exerts the pressure, and one proximal to the hilt and which avoids pressure threaded area of the supply pipe.

In still another illustrative embodiment of a tool for installing shower head supply pipes, the handle has the added function of having yet another useful tool such as a different sized head.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE PREFERRED EMBODIMENT OF THE PRESENT INVENTION

Figure 1:
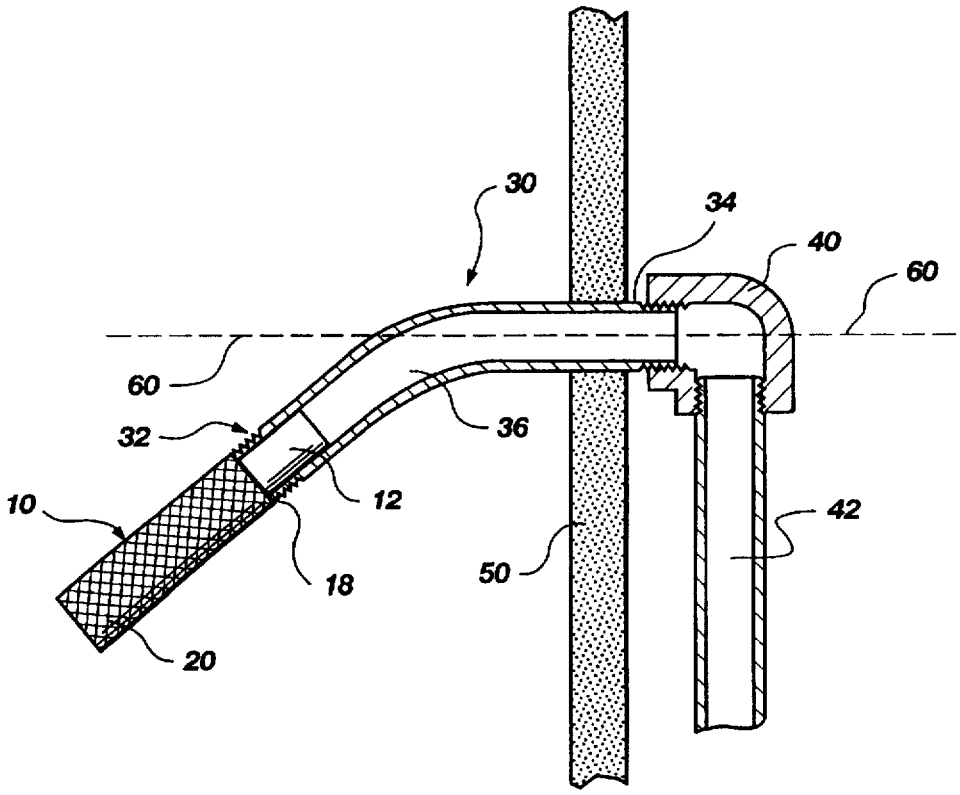
FIG. 1 is a side view of a tool for installing decorative shower head supply pipes made in accordance with the principles of the present invention, as it is used in conjunction with a cross sectional view of a decorative shower supply pipe, a service pipe and a wall of a shower stall.

Reference will now be made to the drawings wherein like structures will be provided with like reference numerals.

Figure 2:
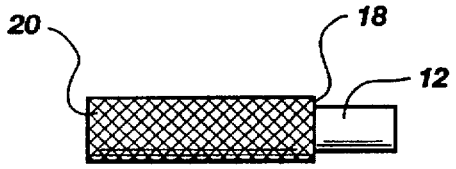
FIG. 2 is side view of the tool of FIG. 1.

Referring to FIGS. 1–2, there is shown, generally designated at 10, a tool for installing shower head supply pipes. The tool has a head 12, a hilt 18, and an elongate handle, 20. The handle 20 is scored to add grip.

The head 12 is inserted into the first hollow end 32 of a shower head supply pipe, generally depicted at 30. The shower head supply pipe also has a second 34 end which threadingly engages an elbow 40 of a water service pipe 42; and a bend 36 for bringing the water to an appropriate terminus within the shower stall. A shower wall is also depicted at 50, which hides the service pipe and forms a part of the interior of the shower stall (not fully depicted). The threading engagement of the second end 34 of the decorative shower supply pipe 30, with the elbow 40 of the service pipe 42, defines a central axis of rotation 60. The decorative shower supply pipe is then rotated using the length of the tool 10, including primarily the elongate handle 20 to rotate the combination about the axis of rotation 60. It will be appreciated that the elongate handle can be manufactured at an appropriate length to achieve sufficient torque to properly install the shower supply pipe. It has been found that approximately 10 inches is sufficient.

The longer cylindrical head 12 is, the less pressure it exerts on the interior of the pipe 30. If the head 12 is too long it interferes with and possibly mars the bend 36 upon insertion and use; if it is too short, it may exert too much pressure on the threaded first end 32 of the pipe 30. It has been found that the effective length of head 12 should be slightly longer than the diameter of the pipe 30. For example, a head 12, inserted approximately 1 inch into a ¾ inch pipe 30, is sufficient to prevent excessive pressure, and also short enough to be obstructed by the bend 36 and to keep disconfiguration of even the softest pipes 30 to an area obscured by a shower head (not depicted) during normal use.

In order to insure proper insertion, the tool 10 has a hilt 18 to stop the head 12 at the predetermined distance within the pipe 30.

The tool 10 can be made of unitary construction by means known to mold or fashion such. It must be made of a rigid material which will withstand the pressures of use, such as steel. It has also been found that use of a rigid but softer material such as brass or aluminum will additionally prevent disconfiguration of pipe 30, wile allowing effective use of the tool 10.

Figure 3:
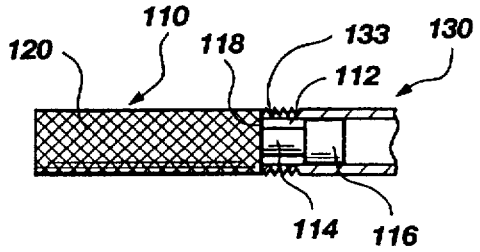
FIG. 3 is a side view of a second preferred embodiment of a tool for installing decorative shower head supply pipes made in accordance with the principles of the present invention, and having a multi-diameter head, together with a cross sectional view of a portion of the supply pipe; and, FIG. 4 is a side view of yet another preferred embodiment of a tool for installing decorative shower head supply pipes made in accordance with the principles of the present invention, and having a multi-purpose handle.

Depicted in FIG. 3, generally at 110, is a second preferred embodiment of a tool for installing decorative shower head supply pipes made in accordance with the principles of the present invention, and having a multi-diameter head 112, together with a cross sectional view of a portion of the supply pipe 130. The tool 110 also has a hilt 118 and an elongate handle, 120.

The head 112 has two regions, region 114 and 116. Region 116 has an outside diameter complementary to, but slightly smaller than an inside diameter of pipe 130. Region 114 has a diameter smaller than the diameter of region 116. As described above, the effective length of the head 112 (in this case the length of region 116) should be longer than the diameter of the pipe 130.

Region 114 of the head 112, in combination with the hilt 118, extends and positions the effective area of the head 112 beyond the threaded area 133 of the pipe 130. This prevents any disconfiguration of the threaded area 133, and confines such to an area which is likely to be obstructed from view by the shower head (not depicted). The combination also, as outpiped above, confines the head 112 to an area away from a bend (see FIG. 1) in the pipe 130.

Figure 4:
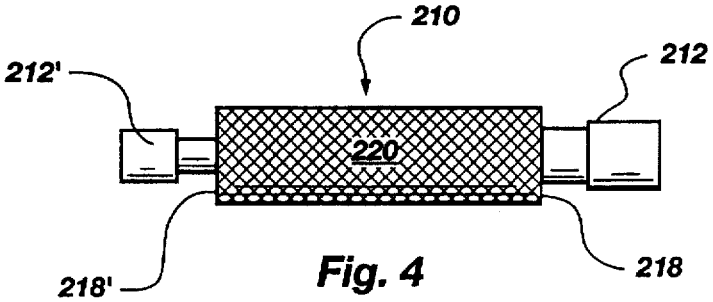

Depicted in FIG. 4, is yet another preferred embodiment of a tool, generally depicted at 210, for installing decorative shower head supply pipes, made in accordance with the principles of the present invention, and having a multi-purpose handle 220. As in other embodiments, the tool 210 has a hilt 218, a head 212 and a handle 220. These function as previously described. Additionally, on an opposing end of the handle 220, is a second tool, in this case comprising a hilt 218' and a head 212'. The second tool could be a screw driver head or any other tool used in conjunction with installation of such fixtures. The diameters of heads 212 and 212' are different to allow the installation of supply pipes of different sizes.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A tool for threadingly engaging bent decorative shower supply pipes with a service pipe, said tool comprising:

a cylindrical head for insertion in a hollow first end of the supply pipe, a hilt to preclude movement of the cylindrical head into the supply pipe beyond a predetermined distance wherein the cylindrical head has a first diameter proximal to the hilt and a second diameter distal to the hilt and wherein said first diameter is smaller than said second diameter and an elongate handle for rotation of the first end about the central axis of a second end of the supply pipe such that threads on the second end rotatingly engage the service pipe.

2. A tool as in claim 1 wherein the second diameter is uniform for a longitudinal distance which is greater than an inside diameter of the hollow first end.

3. A tool as in claim 2 wherein the first diameter is uniform for a longitudinal distance substantially equal to the longitudinal distance of threads on the first end of the supply pipe.

4. A tool as in claim 1 wherein said handle further comprises a combination of tools.

5. A tool as in claim 1 wherein said head is comprised of material which is softer than the composition of the shower supply pipe.

6. A tool as in claim 1 wherein said head is comprised of brass.

7. A tool as in claim 1 wherein said head is comprised of aluminum.

8. A tool for rotating threads of a bent supply pipe relative to threads of a service pipe, said tool comprising head of material which is softer than the composition of the shower supply pipe, for insertion into a first hollow end of the supply pipe opposite the service pipe and an elongate handle for rotating the supply pipe about a central axis of the threads of the service pipe.

9. A tool as in claim 8 wherein said head has an outer geometry complementary to the inside geometry of the hollow end of the supply pipe.

10. A tool as in claim 8 further comprising a hilt for stopping insertion of the head into the supply pipe beyond a predetermined distance.

11. A tool as in claim 10 wherein the head is cylindrical and has a first diameter proximal to the hilt and a second diameter distal to the hilt and wherein said first diameter is smaller than said second diameter.

12. A tool as in claim 11 wherein the longitudinal distance of said second diameter is greater than an inside diameter of the hollow first end.

13. A tool as in claim 12 wherein the longitudinal distance of said first diameter is substantially equal to the longitudinal distance of threads on the first end of the supply pipe.

14. A tool as in claim 8 wherein said handle further comprises a combination of tools.

15. A tool as in claim 8 wherein said head is comprised of brass.

16. A tool as in claim 8 wherein said head is comprised of aluminum.

* * * * *